US007331557B2

(12) United States Patent
Dewert

(10) Patent No.: US 7,331,557 B2
(45) Date of Patent: Feb. 19, 2008

(54) FURNITURE DRIVE EMBODIED AS A DOUBLE DRIVE

(75) Inventor: Eckhardt Dewert, Zürich (CH)

(73) Assignee: Linak A/S, Nordborg (DK)

( * ) Notice: Subject to any disclaimer, the term of this patent is extended or adjusted under 35 U.S.C. 154(b) by 326 days.

(21) Appl. No.: 10/381,396

(22) PCT Filed: Aug. 3, 2001

(86) PCT No.: PCT/EP01/09000

§ 371 (c)(1),
(2), (4) Date: Mar. 21, 2003

(87) PCT Pub. No.: WO02/24035

PCT Pub. Date: Mar. 28, 2002

(65) Prior Publication Data

US 2004/0020316 A1 Feb. 5, 2004

(30) Foreign Application Priority Data

Sep. 21, 2000 (DE) ..... 100 46 750

(51) Int. Cl.
*F16M 13/00* (2006.01)

(52) U.S. Cl. ..... 248/419; 248/420; 297/330

(58) Field of Classification Search ..... 248/419, 248/420, 421, 157, 413, 416, 161; 297/330, 297/362.14, 354.13, 377; 5/610, 616, 617, 5/618, 619, 620, 634

See application file for complete search history.

(56) References Cited

U.S. PATENT DOCUMENTS 140,646 A * 7/1873 Robinson ..... 5/617
276,515 A * 4/1883 White ..... 5/617
1,866,397 A * 7/1932 Clewley ..... 5/632
2,189,325 A * 2/1940 Rich ..... 5/618
2,197,304 A * 4/1940 Haynes ..... 5/608
3,931,653 A * 1/1976 Bien ..... 5/634
4,120,057 A * 10/1978 Neumann ..... 5/616
4,173,372 A * 11/1979 Norris ..... 297/344.17
5,063,623 A * 11/1991 Bathrick et al. ..... 5/616
5,075,911 A 12/1991 Dewert
5,285,992 A * 2/1994 Brown ..... 248/421
5,299,851 A * 4/1994 Lin ..... 297/284.5
5,806,824 A * 9/1998 Isomura et al. ..... 248/396

(Continued)

FOREIGN PATENT DOCUMENTS

| | | |
|---|---|---|
| DE | 29603173 | 5/1995 |
| DE | 29607493 | 8/1996 |
| DE | 296 12 493 | 10/1996 |
| DE | 19718255 | 9/1998 |
| EP | 1 014 834 | 10/2001 |
| WO | WO 99/27819 | 6/1999 |

*Primary Examiner*—A. Joseph Wujciak, III
(74) *Attorney, Agent, or Firm*—Dykema Gossett PLLC

(57) ABSTRACT

A furniture drive which is embodied as a double drive and used to move parts of a piece of furniture in relation to each other. The furniture drive comprises two drive units, each one having a linearly movable drive element for pivoting a pivot lever which co-operates with a part to be moved of the piece of furniture when the furniture drive is in the assembly position. The linearly movable drive element or an actuating element connected thereto comprises a recess into which the pivot lever projects in the radial direction thereof when the furniture drive is in the assembled position. An inner wall of the recess forms a bearing surface for the pivot lever. The furniture drive has a low overall height and a simple design, and can thus be produced economically.

23 Claims, 6 Drawing Sheets

Figure 1:
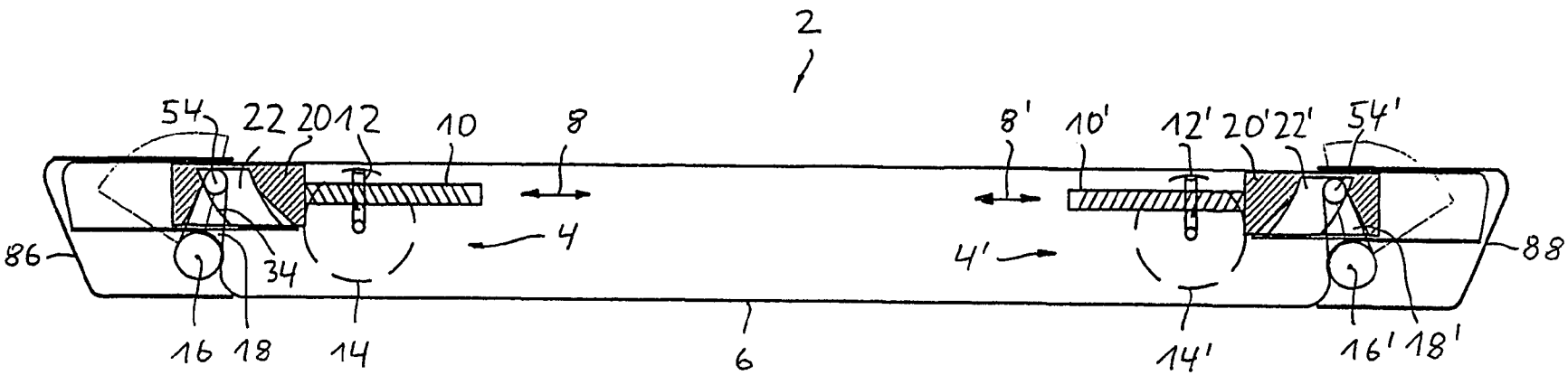

U.S. PATENT DOCUMENTS 5,829,077 A * 11/1998 Neige ..... 5/618
5,884,970 A * 3/1999 Howard ..... 297/362.14
6,055,877 A * 5/2000 Welterlin et al. ..... 248/429
6,269,707 B1 * 8/2001 Koch ..... 74/89.23
6,520,582 B2 * 2/2003 Glance ..... 297/362.14
6,547,332 B2 * 4/2003 Pejathaya ..... 297/362.14
6,575,421 B1 * 6/2003 Houston et al. ..... 248/429
6,637,818 B2 * 10/2003 Williams ..... 297/330
6,679,555 B2 * 1/2004 Bangert ..... 297/316
6,754,922 B2 * 6/2004 Dewert ..... 5/617
6,763,536 B2 * 7/2004 Dewert ..... 5/618
2004/0075322 A1 * 4/2004 Jaeger et al. ..... 297/325

* cited by examiner

FURNITURE DRIVE EMBODIED AS A DOUBLE DRIVE

The invention relates to a furniture drive, embodied as a double drive, of the type mentioned in the introductory portion of claim 1 for moving parts of a piece of furniture relative to one another.

Such furniture drives are known in general and serve, for example, as adjustment drives for the movement or adjustment of parts of a lattice structure relative to one another.

EP 0 372 032 B1 discloses a furniture drive, embodied as a double drive, for the adjustment of parts of a piece of furniture relative to one another, and is provided with two drive units. Each drive unit of the known furniture drive cooperates with a pivot lever that in the assembled position of the furniture drive is in functional connection with a part of the piece of furniture that is to be adjusted. With the known furniture drive, each drive unit has a linearly movable drive element that is in functional connection with the pivot lever for pivoting the latter. In this connection, the pivot lever is embodied as an angle lever upon which the linearly movable drive element, which is formed by a spindle nut that is disposed on an adjusting spindle, exerts pressure for pivoting the pivot lever and is thus in functional connection with the pivot lever.

DE 38 48 078 C2 discloses a similar furniture drive according to which each drive unit also cooperates with a pivot lever. With the furniture drive known from this document, the linearly movable drive element is formed by a spindle nut that is connected with a holding leg, of a right-angled push member, that extends parallel to the spindle axis, whereby the other pressing leg, which is perpendicular to the spindle axis, loosely acts upon the free end of the pivot lever and is thus in functional connection with the pivot lever.

EP 0 583 660 B1 discloses a furniture drive, embodied as a double drive, of the type in question for adjusting parts of a piece of furniture relative to one another, and has two drive units. Each drive unit of this furniture drive has a linearly movable drive element in the form of a spindle nut that serves for the pivoting of a pivot lever that, in the assembled position of the furniture drive, is in functional connection with a part of the piece of furniture that is to be adjusted. On that end that faces the pivot lever, the spindle nut is provided with a slot that extends perpendicular to the spindle axis and in which the pivot lever engages, and is tightly guided, via a pin disposed at the end of the pivot lever and extending essentially parallel to the pivot axis of the pivot lever. A drawback of this known furniture drive is that it has a complicated and expensive construction. Furthermore, with this known furniture drive non-symmetrical stressing of the pivot lever occurs since the point of force engagement of the drive element is disposed beyond the longitudinal central plane of the pivot lever.

The object of the invention is to provide a furniture drive, embodied as a double drive that is simple in construction and hence economical to manufacture, and is also sturdy.

According to the teaching of claim 1, the linearly movable drive element, or an actuating element connected therewith, is provided with a recess into which the pivot lever, which as a rule is not part of the furniture drive, but rather of a piece of furniture, for example a lattice structure, projects in the assembled position, whereby an inner wall of the recess forms an abutment surface for the pivot lever.

In this way there results a straightforward and hence more economical construction of the inventive furniture drive with relatively few components.

A particular advantage of the inventive furniture drive is that the pivot lever can be made shorter than is the case with the known furniture drives. In this way, the inventive furniture drive can be designed with a relatively low overall height. This has the significant advantage that when combining, for example, a lattice structure with an inventive furniture drive, the thus-formed unit has an overall height that is not, or is only slightly, greater than the overall height of the lattice structure itself.

A further advantage of the inventive furniture drive is that it has a sturdy construction and is suitable for the application of great forces.

A further advantage is that with the inventive furniture drive, the point of application of force of the actuating element against the pivot lever can be disposed in the longitudinal plane of the pivot lever, thus avoiding an non-symmetrical stressing of the pivot lever.

The inventive furniture drive is embodied as a dual or double drive. While basically maintaining the inventive principle of operation, it is, however, also possible to embody the furniture drive as a single drive.

An extremely advantageous further development of the inventive teaching provides for at least one slot in the abutment surface for receiving the lever arm of the pivot lever in at least one end position of the adjustment movement, and that the pivot lever, at a distance from the slot, rests against the abutment surface via an abutment member. With this embodiment, the free end of the pivot lever can extend deeply into the recess, so that the furniture drive has a particularly low overall height. While the pivot lever rests against the abutment surface via the abutment member, an undesired butting of the lever arm of the pivot lever against the abutment surface remote from the abutment member is avoided since this member of the pivot lever can be received in the slot. Thus, this embodiment enables a large pivot angle of the pivot lever accompanied by a simultaneous very compact construction.

A further development of the aforementioned embodiment provides that the abutment member extends essentially parallel to the pivot axis of the pivot lever. With this embodiment, the abutment member thus extends transverse to the slots, whereby a reliable contact against the abutment surface is ensured.

Another extremely advantageous further development provides that the pivot lever be embodied in a fork-shaped manner with two spaced-apart lever arms that extend parallel to one another, and that the abutment lever be held between the abutment arms of the pivot lever. This embodiment also enables a large pivot angle of the pivot lever with a simultaneously compact construction. Due to the lever arms that are spaced from one another, a symmetrical introduction of force, relative to the central longitudinal plane of the pivot lever, from the drive element or the actuating element into the pivot lever is facilitated. Non-symmetrical stressing of the pivot lever, which can lead to deformation and possibly damage thereto, is thereby avoided.

A further development of the aforementioned embodiment provides that the abutment surface is formed on a projection, whereby the inside width between the lever arms of the pivot lever essentially corresponds to or is greater than the dimension of the projection in this direction. With this embodiment, during the adjustment movement the abutment member of the pivot lever rests against the abutment surface, while the lever arms move laterally along the projection.

Another further development of the embodiment having the fork-shaped pivot lever provides that in the abutment surface, or in the region of the abutment surface, there are formed two slots that are spaced apart parallel to the pivot axis of the pivot lever and that extend essentially perpendicular to the pivot axis of the pivot lever, the slots being provided for receiving the spaced-apart lever arms of the pivot lever in an end position of the adjustment movement. With this embodiment, the stability of the components in which the recess is formed is improved relative to the aforementioned embodiment.

In principle, with the embodiment having the slot it is adequate if only at least one slot is formed in the abutment surface. However, pursuant to an expedient further development, one or more slots are formed in an inner wall of the recess that is remote from the abutment surface, whereby each lever arm of the pivot lever is associated with a slot for receiving the lever arm in at least one end position of the adjustment movement. In this way, a butting of the lever arm of the pivot lever against that inner wall of the recess that is opposite the abutment surface is prevented, so that the pivot angle of the pivot lever that can be achieved is increased even further.

With the embodiments having the slot or the slots, the open width of each slot expediently corresponds essentially to the dimension of the associated lever arm parallel to the pivot axis of the pivot lever, or is somewhat greater than this dimension. With this embodiment, the stability of the drive element or of the actuating element is adversely affected by the slots only to the extent that this is necessary due to the width of the lever arm, which can be kept small.

The shape and size of the abutment member can be selected over wide ranges. The abutment member can, for example, be plate-shaped or rod-shaped. One advantageous further development provides that the abutment member be formed by a roller that is preferably rotatably mounted on the free end of the pivot lever. In this embodiment, the friction of the abutment member against the abutment surface is reduced, so that power loss due to friction, as well as a wearing-away of the abutment surface, are avoided.

The shape of the drive element or of the actuating element is selectable over wide ranges. One advantageous further development provides that the drive element or the actuating element be open on one side relative to a side that in the assembled position faces the pivot lever. In this embodiment, the drive element or actuating element are embodied in the manner of a housing and are open only toward the pivot lever, otherwise however being closed. In this way a high stability is achieved.

In principle, the abutment surface can extend essentially perpendicular to the linear movement axis of the drive element. However, the abutment surface is expediently inclined relative to the linear movement axis of the drive element. In this way the pivot angle of the pivot lever that can be achieved is increased.

With the aforementioned embodiment, the abutment surface can be an essentially planar surface that is preferably inclined at an acute angle relative to the linear movement axis of the drive element. However, the abutment surface can also, at least in sections, have a curved cross-sectional configuration, whereby preferably an imaginary connecting line between end points of the curved cross-section of the abutment surface is inclined at an acute angle relative to the linear movement axis of the drive element. In this embodiment, particularly favorable conditions result with respect to the articulation angle of the pivot lever against the abutment surface.

A further development of the embodiment having the abutment surface with the curved cross-section is that the abutment surface have a concave cross section relative to the pivot lever.

Pursuant to another advantageous further development, the open width between the abutment surface and an oppositely disposed inner wall of the recess is greater than the dimension of the pivot lever or of the abutment member between the abutment surface and the opposite inner wall. This prevents a wedging or seizing of the pivot lever or of the abutment member in the recess.

The component in which the recess if formed can be made of any desired suitable material. The component is expediently made of polymeric material, as provided by a further development. In this embodiment, the manufacture of the inventive furniture drive is further simplified and hence more economical, since the drive element or the actuating element can be a simple and economical molded plastic part.

The linearly movable drive element can have any desired suitable configuration. One expedient further development provides that the linearly movable drive element be a spindle nut that is held on a rotatable adjusting spindle in a manner protected against torsion and movable in an axial direction. Such spindle drives are available as simple and economical standard components, thus further simplifying the manufacture of the furniture drive and hence providing an economical design. Since the spindle nut is generally a molded plastic part, the recess can be formed therein during the manufacture of the spindle nut.

In a kinematic reversal of the aforementioned embodiment, the linearly movable drive element can, however, also be an adjusting spindle that is mounted so as to be protected against torsion and movable in its axial direction, with a stationary, rotatable spindle nut being disposed on the adjusting spindle.

Another further development of the inventive teaching provides that in the assembled position of the furniture drive the pivot lever is fixedly connected with a rotatably mounted shaft that is in functional connection with a part of the piece of furniture that is to be moved or adjusted. In this connection, the pivot lever is generally not part of the furniture drive, but rather of an adjustment fitting, for example on a lattice structure. The pivot lever can, however, also be part of the furniture drive.

Pursuant to other expedient further developments, each drive unit is provided with an electric motor, and/or the drive units of the double drive are accommodated in a common housing.

The invention will be subsequently explained in greater detail with the aid of the accompanying schematic drawings in which an embodiment is illustrated.

BRIEF DESCRIPTION OF THE PREFERRED EMBODIMENT

Figure 2:
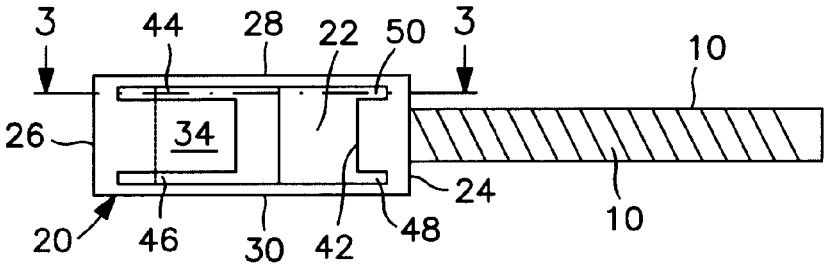
Figure 3:
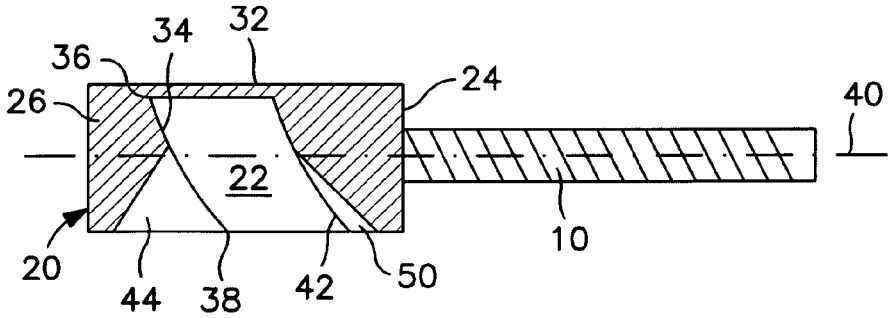
Figure 4:
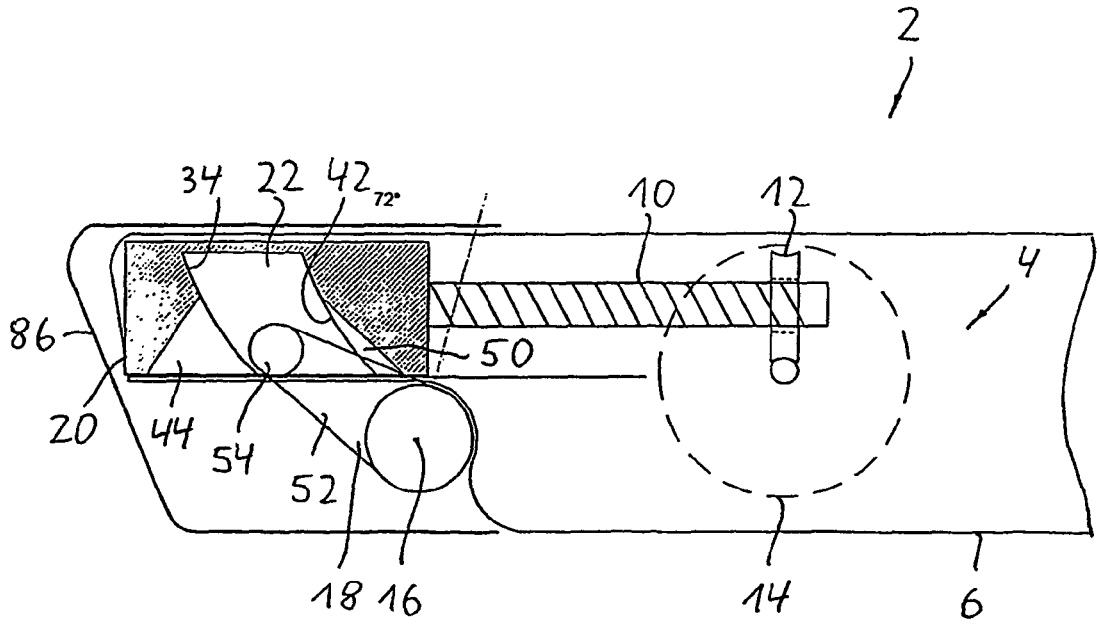
Figure 5:
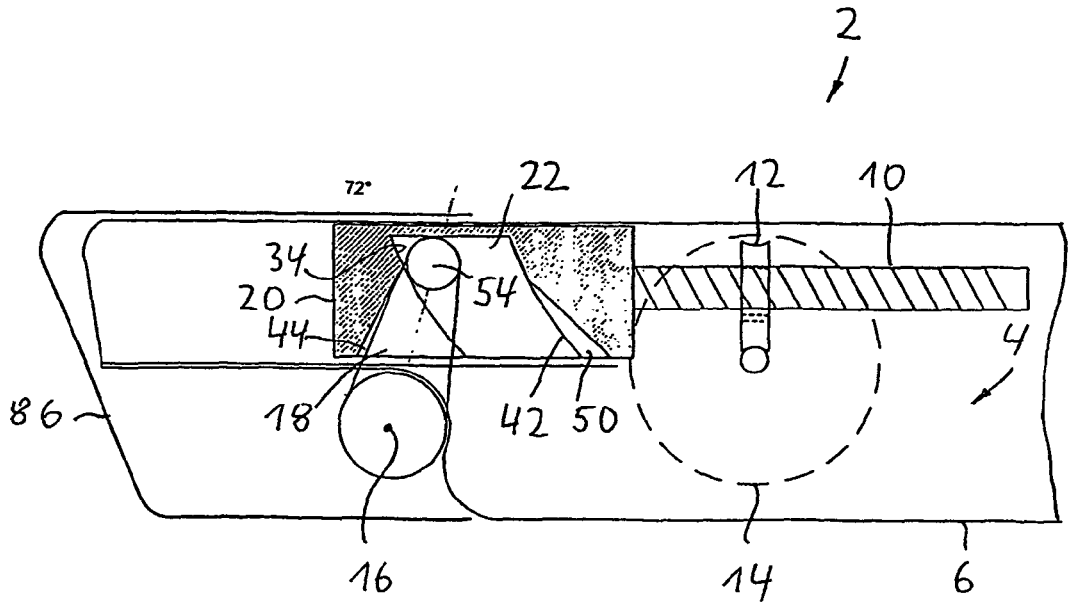
Figure 6:
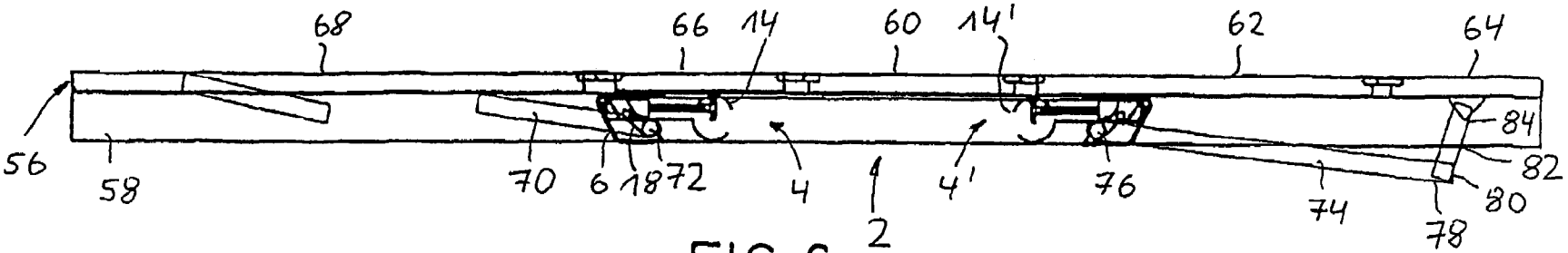
Figure 7:
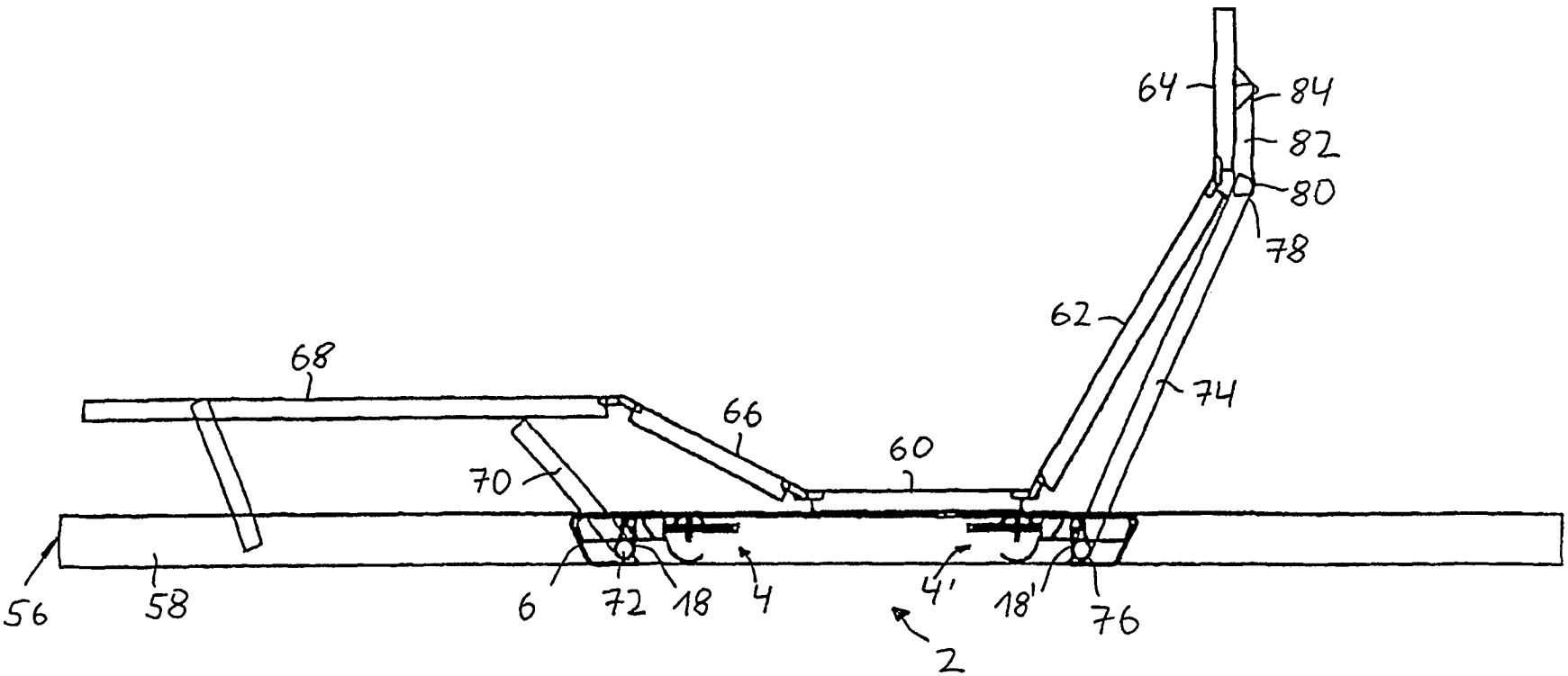
Figure 8:
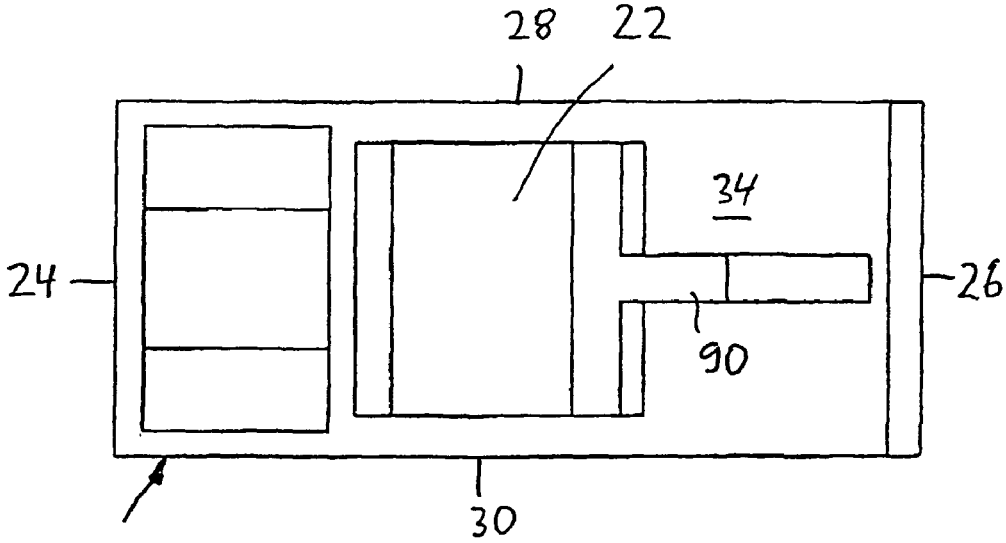
Figure 9:
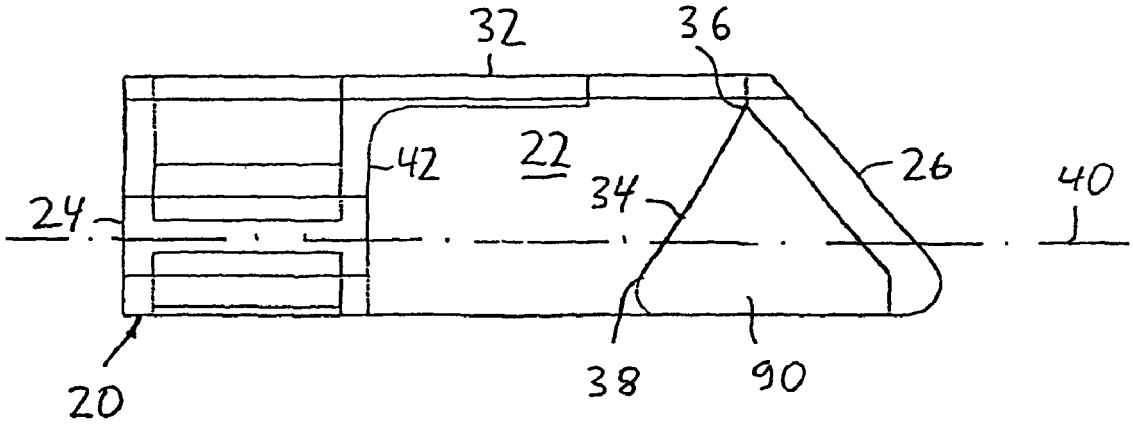

FIG. 1 is a schematic side view of one embodiment of an inventive furniture drive, whereby for reasons of illustration a portion of the housing in which the drive units are accommodated is omitted, FIG. 2 is a view from below in FIG. 1 onto an actuating element of a drive unit of the embodiment of FIG. 1, FIG. 3 is a cross-sectional view taken along the line 3-3 in FIG. 2, FIG. 4 is the same illustration, enlarged relative to FIG. 1 of a drive unit of the furniture drive of FIG. 1 in a first adjustment position, FIG. 5 is the same illustration as FIG. 4 of the drive unit of FIG. 4 in a second adjustment position, FIG. 6 is a schematic side view of an embodiment of a support device for a cushion of furniture for sitting and/or resting in the form of a lattice structure that is provided with a furniture drive according to FIG. 1 in a first adjustment position, FIG. 7 is the support device of FIG. 6 in a second adjustment position, FIG. 8 is a view similar to FIG. 2 of an actuating element of a second embodiment of an inventive furniture drive, and FIG. 9 is a view similar to FIG. 3 of the actuating element of FIG. 8.

FIG. 1 illustrates one embodiment of an inventive furniture drive 2, which in this embodiment is embodied has a double drive and as two drive units 4, 4' that are accommodated in a common housing 6 and are held thereon by non-illustrated fastening means. Only the drive unit 4 will be explained in greater detail subsequently. The drive unit 4' is correspondingly constructed, and its components are provided with reference symbols that correspond to the reference symbols of the components of the drive unit 4.

The drive unit 4 has a linearly-movable drive element, which in this embodiment is formed by an adjusting spindle 10 that is movable back and forth in its axial direction in the direction of a double arrow 8, and which in this embodiment is embodied as a threaded spindle. Disposed upon the adjusting spindle 10, which is mounted in such a way as to be protected against torsion, as will be explained further. Subsequently, is a stationary spindle nut 12 that is provided with an internal thread and which, by means of an electric motor 14 that is indicated only schematically in the drawing, is rotatable via a non-illustrated gear mechanism. The drive units 4,4' can be controlled together or separately from one another by means of control means that are not illustrated in the drawing. Similarly, non-illustrated power supply means are provided for supplying power to the drive units 4,4'.

In the assembled position of the furniture drive 2, the adjusting spindle 10 is functionally connected with a pivot lever 18, which is pivotably mounted about a pivot axis 16, for the pivoting of the pivot lever. In this embodiment, the pivot lever 18 is not part of the furniture drive 2, but rather is part of an adjustment fitting of a support device, not illustrated in FIG. 1, for supporting a cushion of furniture for sitting and/or resting, for example of a lattice structure or grating.

For the pivoting of the pivot lever 18, the drive unit 4 is provided with an actuating element 20 that is connected with that end of the adjusting spindle 10 that faces the pivot lever 18, whereby the connection between the adjusting spindle 10 and the actuating element 20 is able to withstand pushing and pulling.

In this embodiment, the actuating element 20 is made of polymeric material and is embodied in the manner of a housing and is open on one side toward the pivot lever 18. It is provided with a recess 22 into which the pivot lever 18 extends in its radial direction, as can be seen from FIG. 1. To clarify the manner in which the inventive furniture drive functions, the actuating element 20 is shown sectioned in the side view of FIG. 1.

FIG. 2 shows a view from below in FIG. 1 onto the actuating element 20 of FIG. 1, whereby it can be seen that the actuating element 20 is closed on its narrow side 24, which faces the adjusting spindle 10, as well as on its opposite narrow side 26, as well as on its long sides 28, 30. From FIG. 3, which is a cross-sectional view taken along a line 3-3 in FIG. 2, it can be seen that the actuating element 20 is also closed on its upper side 32. In this way, the actuating element 20 is particularly stable.

By means of an inner wall of the recess 22, an abutment surface 34 is formed for the free end of the pivot lever 18, which is not illustrated in FIG. 3, the abutment surface having a curved or arcuate cross-section and extending concavely relative to the pivot lever 18. An imaginary connecting line between end points 36, 38 of the curved cross-section of the abutment surface 22 forms an acute angle with a linear movement axis of the adjusting spindle 10, which is indicated in FIG. 3 by a dot-dash line 40.

By means of an inner wall of the recess 22, and abutment surface 34 is formed for the free end of the pivot lever 18, which is not illustrated in FIG. 3, the abutment surface having a curved or arcuate cross-section and extending concavely relative to the pivot lever 18. An imaginary connecting line between end points 36, 38 of the curved cross-section of the abutment surface 22 forms an acute angle with a linear movement axis of the adjusting spindle 10, which is indicated in FIG. 3 by a dot-dash line 40.

An inner wall 42 of the recess 22 that is disposed across from the abutment surface 34 is also curved and extends essentially parallel to the abutment surface 34.

In a direction parallel to the pivot axis 16, next to the abutment surface 34, the actuating element 20 is provided with slots 44, 46 that extend from the abutment surface 34 in the direction toward the end 26 of the actuating element 20, and extend essentially perpendicular to the pivot axis 16 of the pivot lever 18. In a corresponding manner, slots 48,50 extend from the wall 42 in the direction toward the narrow side 24 of the actuating element 20.

It cannot be seen from the drawing, and is therefore not explained here, that the pivot lever 18 in this embodiment has a fork-shaped configuration and is provided with two narrow lever arms that are parallel to one another and in a direction parallel to the pivot axis 16 are spaced from one another, with only one lever arm 52 being seen in the drawing. Between the lever arm 52 and the other lever arm, there is held on that end of the pivot lever that is remote from the pivot axis 16 an abutment member for engagement against the abutment surface 34, whereby in this embodiment the abutment member is formed by a roller that is mounted on the pivot lever 18 so as to be rotatable about an axis that is parallel to the pivot axis 16.

The movement or adjustment position of the drive unit 4 illustrated in FIG. 4 corresponds, in the embodiment, to a first end position in which the parts of the piece of furniture that is not illustrated in FIG. 2, which parts are movable by means of the furniture drive, are not moved relative to one another. In this end position, the roller 54 is not in engagement with the abutment surface 34, as can be seen from FIG. 4. The lever arm 52 of the pivot lever 18 extends into the slot 50, while the other lever arm that is not seen in the drawing extends into the slot 48.

To pivot the pivot lever 18, and hence to move a part of a piece of furniture that is functionally connected with the pivot lever 18, but is not illustrated in FIG. 4, the spindle nut 12 is rotatably driven by the electric motor 14 in such a way that the adjusting spindle 10 is moved to the right in FIG. 4 together with the actuating element 20. In the process, the roller 54 of the pivot lever 18 runs up upon the abutment surface 34, which during the further course of the adjustment movement lightly contacts the pivot lever 18 and exerts a traction force upon the pivot lever 18, due to which the pivot lever 18 is pivoted about its pivot axis 16 in a clockwise direction in FIG. 4.

During the further course of the adjustment movement, the roller 54 moves upwardly along the abutment surface 34 in FIG. 4, so that the pivot lever 18 is pivoted further about its pivot axis 16.

During the pivoting, the pivot lever 18 moves a part of a piece of furniture that is not illustrated in FIGS. 1 to 5, with the pivot lever 18 being in functional connection with the piece of furniture in a suitable manner.

FIG. 5 illustrates the other end position of the adjustment movement, which corresponds to a maximum adjustment or movement of the part of the non-illustrated piece of furniture that is to be moved. In this second end position of the adjustment movement, the lever arm 52 extends into the slot 44 and the other lever arm of the pivot lever 18 extends into the slot 46.

As can be seen from a comparison of FIGS. 4 and 5 the slots 44, 46 or 48, 50 prevent the pivot lever 18, in the region of the end positions of the adjustment movement, from butting against the walls of the recess 20 with that portion thereof that faces the pivot axis 16. Thus, the slots 44, 46 or 48, 50 make it possible for the pivot lever 18 to extend far into the recess 22 to the region of the upper wall of the actuating element 20, so that while at the same time having a large pivot angle of the pivot lever 18 between its end positions, in the embodiment approximately 72°, an extremely low overall height of the drive unit 4, and hence of the overall furniture drive 2, is made possible.

Since the abutment surface 34 has a curved cross section and is concave towards the roller 54, particularly favorable conditions result with regard to the angle that changes during the adjustment movement and at which the actuating element 20 engages against the pivot lever.

As can be seen from FIGS. 4 and 5, the inside width between the abutment surface 34 and the oppositely disposed wall 42 of the recess 22 is greater than the dimension of the roller 54 in this direction. This avoids a wedging or seizing of the roller 54 in the recess 22. Furthermore, in this way, if, with the influence of a user, a part of a piece of furniture that has been adjusted via the pivot lever 18 tries to move the pivot lever 18 that is in the second end position that is illustrated in FIG. 5 further in the clockwise direction, there is avoided that the roller comes to rest against the inner wall 42, thereby placing the actuating element under pressure.

FIG. 6 illustrates a support device, provided with the furniture drive 2, for supporting a cushion of a piece of furniture for sitting and/or resting, whereby in this embodiment the support device is formed by a lattice structure 56. The lattice structure 56 is provided with a frame 58 as well as a plurality of hingedly interconnected support elements. In detail, the lattice structure is provided with a central support element 60, with one side of which an upper body support element 62 is hingedly connected and is pivotable about a horizontal pivot axis, with that side of the upper body support that is remote from the central support element 60 a head support element 64 is pivotably connected and is pivotable about a horizontal pivot axis. A leg or thigh support element 66 is hingedly connected with that side of the central support element 60 that is remote from the upper body support element 62 and is pivotable about a horizontal pivot axis, and a calf support element 68 is hingedly connected with that side of the leg support element that is remote from the central support element 60 and is pivotable about a horizontal pivot axis.

To adjust or move the leg support element 66 and the calf support element 68 relative to the central support element 60, a pivotable adjustment lever 70 is provided that is fixedly connected with a pivot shaft 72 with which also the pivot lever 18 is fixedly connected. The adjustment lever 70 is thus pivotable together with the pivot lever 18 about the pivot axis 16 of the latter. The underside of the leg support element 68 rests loosely upon the adjustment lever 70.

To move or adjust the upper body support element 62 and the head support element 64 relative to the central support element 64, a further adjustment lever 74 is provided that is fixedly connected with a further pivot shaft 76 with which also the pivot lever 18' that is associated with the drive unit 4' is fixedly connected. The further adjustment lever 74 is pivotable together with the pivot lever 18' about the pivot axis 16' of the latter.

One end 80 of a link lever 82 is hingedly connected with that end 78 of the adjustment lever 74 that is remote from the pivot lever 18', and the other end 84 of the link lever is hingedly connected with the head support element 64.

FIG. 6 shows the lattice structure 56 in a position in which the support elements 62, 64, 66, 68 are not moved relative to the central support element 60. To move or adjust the leg support 66 and the calf support element 68 relative to the central support element 60, the electric motor 14 drives the spindle nut 12 in such a way that the adjusting spindle 10, together with the actuating element, are moved toward the right in FIG. 6, so that the pivot lever 18 is taken along by the actuating element 20 and in so doing is pivoted in a clockwise direction in FIG. 6 about its pivot axis 16. In this connection, the adjustment lever 70 correspondingly also pivots in the clockwise direction and moves the calf support element 68, together with the leg support element 66, until the end position of the adjustment movement illustrated in FIG. 7 is achieved.

In a corresponding manner, for adjusting or moving the upper body support element 62 and the head support element 64 relative to the central support element 60, the electric motor 14' of the drive unit 4' drives the spindle nut 12' in such a way that the adjust together with the actuating element 20', are moved toward the left in FIG. 6. In so doing, the pivot lever 18' is taken along by the actuating 20' and is pivoted in the clockwise direction in FIG. 6 so that also the further adjustment lever 74 is pivoted and the upper body support element 62 and the head support element 64 are moved until the end position of the adjustment movement illustrated in FIG. 7 is achieved.

For returning to the adjustment position illustrated in FIG. 6, the electric motor 14 drives the spindle nut 12 such that the adjusting spindle 10, together with the actuating element 20, are moved toward the left in FIG. 6. In so doing, the leg support element 66 and the calf support element 68 are returned under the effect of their weight. The return of the upper body support element 64 is effected in a corresponding manner.

The inventive furniture drive 2 is straightforward and economical in construction as well as sturdy. Due to the inventive configuration of the actuating elements 20 and 20', the pivot levers 18, 18' can be relatively short, so that a compact construction with a low overall height results.

As can be seen from FIGS. 6 and 7, due to this low overall height, the inventive furniture drive 2 does not project beyond the frame 28 of the lattice structure 56.

To mount the furniture drive 2 on the lattice structure 56, the housing 6 is placed, from above, onto the pivot shafts 72, 76 of the fitting of the lattice structure 56, and is secured with cap-shaped protection or retaining elements 86 and 88 (see FIG. 1) whereby the retaining element 86 in FIG. 1 is pressed upon the housing 6 from the left, and the retaining element 88 in FIG. 1 is pressed upon the housing 6 from the right.

The housing 6 can be made of polymeric material and, for absorbing the high forces that occur during operation of the furniture drive 2, can be provided with metal reinforcements.

Illustrated in FIG. 8 is an actuating element 20 of a second exemplary embodiment of an inventive furniture drive 2 that primarily differs from the actuating element of FIG. 2 in that in the region of the abutment surface 34 there is provided merely a single slot 90 that extends from the abutment surface 34 in a direction toward the end 26 of the actuating element 20, and extends essentially perpendicular to the pivot axis 16 of the pivot lever, which is not illustrated in FIG. 8. In this embodiment, in contrast to the embodiment illustrated in FIGS. 1 to 7, the pivot lever does not have a fork-shaped configuration, but rather has only a single lever arm. An abutment member, which is also not illustrated in FIG. 8, is disposed on the free end of the pivot lever and extends transverse to the slot 90 such that on both sides of the slot 90 the abutment member rests against the abutment surface 34.

Since only a single slot 90 is provided in the abutment surface 34, with this embodiment the stability of the actuating element is improved. In addition, the actuating element 20 is easier to produce.

FIG. 9 shows a longitudinal cross-sectional view through the actuating element 20 of FIG. 8 in the region of the slot 90. From FIG. 9, it can be seen that that wall 42 of the recess 22 that is remote from the abutment surface 34 extends, in this embodiment, perpendicular to the linear movement axis 40. In FIG. 8 and FIG. 9 the adjusting spindle is not illustrated, which is connected with that end 24 of the actuating element 20 that is remote from the abutment surface 34 such that it can withstand pushing and pulling.

The invention claimed is:

1. A furniture drive with a linearly moveable drive element that pivots a pivot lever for adjusting support elements of a support device for a cushion of an article of furniture, wherein the pivot lever is in functional connection with a support element to be moved, wherein the linearly movable drive element includes an adjusting spindle and spindle nut through which said adjusting spindle extends, wherein said linearly movable drive element comprises an actuating element connected to the adjusting spindle, said actuating element being provided with a recess into which said pivot lever extends in a radial direction of said pivot lever, wherein said recess has a first inner wall that forms an abutment surface for said pivot lever, wherein said abutment surface is an essentially planar surface, wherein the abutment surface contacts the pivot lever, and wherein the abutment surface in a direction of a linear moving axis of the drive element is located at an end of the recess facing away from the spindle, wherein the drive element and actuating element being adjusted by the furniture drive pulls the pivot lever to move the support element.

2. A furniture drive according to claim 1, wherein said pivot lever is provided with at least one lever arm, wherein in said abutment surface, or in a region of said abutment surface, at least one slot is provided for receiving said at least one lever arm of said pivot lever in one end position of an adjustment movement, wherein said pivot lever is furthermore provided with an abutment member, and wherein said pivot lever, at a distance from said one slot, rests against said abutment surface via said abutment member.

3. A furniture drive according to claim 2, wherein said abutment member extends essentially parallel to a pivot axis of said pivot lever.

4. A furniture drive according to claim 1, wherein said pivot lever has a fork-shaped configuration with two parallel and spaced-apart lever arms, wherein said pivot lever is provided with an abutment member, and wherein said abutment member is held between said lever arms of said pivot lever.

5. A furniture drive according to claim 4, wherein said abutment surface is formed on a projection, and wherein an inside width between said lever arms of said pivot lever essentially corresponds to, or is greater than, a dimension of said projection in this direction.

6. A furniture drive according to claim 4, wherein in said abutment surface, or in the region of said abutment surface, two slots are formed that are spaced apart parallel to a pivot axis of said pivot lever and that extend essentially perpendicular to said pivot axis, and wherein said slots are provided for receiving said spaced-apart lever arms of said pivot lever in an end position of an adjustment movement.

7. A furniture drive according to claim 6, wherein an inside width of each of said slots essentially corresponds to, or is somewhat greater than, a dimension of an associated lever arm in a direction parallel to a pivot axis of said pivot lever.

8. A furniture drive according to claim 1, wherein said pivot lever is provided with at least one lever arm, wherein in a further inner wall of said recess that is remote from said abutment surface, at least one slot is formed, and wherein said at least one lever arm of said pivot lever is associated with said at least one slot for receiving said at least one lever arm in an end position of an adjustment movement.

9. A furniture drive according to claim 1, wherein said pivot lever is provided with an abutment member, and wherein said abutment member is formed by a rotatably mounted roller disposed on a free end of said pivot lever.

10. A furniture drive according to claim 1, wherein said drive element or said actuating element is open on one side relative to a side thereof that in an assembled position faces said pivot lever.

11. A furniture drive according to claim 1, wherein said abutment surface is inclined relative to a linear movement axis of said drive element.

12. A furniture drive according to claim 11, wherein said abutment surface has a curved cross-section, at least in portions thereof.

13. A furniture drive according to claim 12, wherein an imaginary connecting line between end points of said curved cross-section of said abutment surface is inclined relative to said linear movement axis of said drive element at an acute angle.

14. A furniture drive according to claim 12, wherein said abutment surface has a concave cross-section relative to said pivot lever.

15. A furniture drive according to claim 1, wherein said abutment surface is inclined relative to said linear movement axis of said drive element at an acute angle.

16. A furniture drive according to claim 1, wherein said pivot lever is provided with an abutment member, and wherein an inside width between said abutment surface and an oppositely disposed inner wall of said recess is greater than a dimension of said pivot lever or said abutment member between said abutment surface and said oppositely disposed inner wall.

17. A furniture drive according to claim 1, wherein said linearly movable drive element or the actuating element connected with said drive element in which said recess is formed is made of polymeric material.

18. A furniture drive according to claim 1, wherein in an assembled position of said furniture drive, said pivot lever is connected with a rotatably mounted shaft that is in functional connection with a furniture part that is to be moved.

19. A furniture drive according to claim 1, wherein said furniture drive is embodied as a double drive and is provided with two drive units.

20. A furniture drive according to claim 19, wherein said drive units of said double drive are accommodated in a common housing.

21. A furniture drive according to claim 1, wherein said at least one drive unit is provided with an electric motor.

22. A furniture drive according to claim 1, wherein said spindle nut is rotatable but linearly fixed in position and said adjusting spindle is linearly movable through the spindle nut during rotation of the spindle nut.

23. A furniture drive according to claim 1, wherein said spindle nut is not rotatable but is linearly movable with rotation of said adjusting spindle.

* * * * *